US009377270B2

(12) United States Patent
Stokes

(10) Patent No.: US 9,377,270 B2
(45) Date of Patent: Jun. 28, 2016

(54) CONTINUOUS ARTICULATING ARCHERY STABILIZER

(71) Applicant: Kyle B. Stokes, Annville, PA (US)

(72) Inventor: Kyle B. Stokes, Annville, PA (US)

( * ) Notice: Subject to any disclaimer, the term of this patent is extended or adjusted under 35 U.S.C. 154(b) by 0 days.

(21) Appl. No.: 14/682,308

(22) Filed: Apr. 9, 2015

(65) Prior Publication Data

US 2015/0345892 A1 Dec. 3, 2015

Related U.S. Application Data

(60) Provisional application No. 62/006,543, filed on Jun. 2, 2014.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426; F41B 5/148; F41B 5/066
See application file for complete search history.

(56) References Cited

U.S. PATENT DOCUMENTS 2,191,348 A * 2/1940 Lauterbach ..... A47L 13/24 15/143.1
3,502,062 A * 3/1970 Shurts ..... F41B 5/1426 124/23.1
4,054,121 A * 10/1977 Hoyt, Jr. ..... F41B 5/1426 124/88
4,135,486 A * 1/1979 Enomoto ..... F41B 5/1426 124/89
4,491,123 A * 1/1985 Wirtz ..... B60G 21/0551 124/89
4,553,522 A * 11/1985 Topping ..... F41B 5/1426 124/89
4,556,042 A * 12/1985 Izuta ..... F41B 5/1426 124/88
5,239,977 A * 8/1993 Thomas ..... F41B 5/1426 124/88
5,320,085 A * 6/1994 Hanneman ..... F41B 5/1426 124/86
5,535,731 A * 7/1996 Webster ..... F41B 5/1426 124/89
5,992,403 A * 11/1999 Slates ..... F41B 5/1426 124/89
6,216,317 B1 4/2001 Chen
6,499,478 B1 * 12/2002 Perez ..... F41B 5/14 124/25.6
6,997,174 B2 * 2/2006 Sandberg ..... F41B 5/1426 124/89

OTHER PUBLICATIONS

Doinker V Frame Mount (2011).
Doinker Platinum Adjustable Offset Mount (2010).

* cited by examiner

*Primary Examiner* — Melba Bumgarner
*Assistant Examiner* — Amir Klayman
(74) *Attorney, Agent, or Firm* — Warner Norcross & Judd LLP

(57) ABSTRACT

A stabilizer for an archery bow is provided, the stabilizer including a continuous stabilizer bar having a first segment, a second segment and an articulating, lockable joint joining the first segment and the second segment. The joint enables the first segment and second segment to be selectively positionable at any one of multiple preselected bar angles relative to one another, so that a user can fine tune the orientation, mass distribution, balance and shooting characteristics of a bow to which the stabilizer is joined.

20 Claims, 8 Drawing Sheets

CONTINUOUS ARTICULATING ARCHERY STABILIZER

BACKGROUND OF THE INVENTION

The present invention relates to archery equipment, and more particularly to a stabilizer for an archery bow that is configured to selectively articulate at a particular location along its length for precise weight distribution and balance.

When an arrow is shot from an archery bow, a variety of translational and rotational movements occur around the location where an archer grips the archery bow, that is, the archery bow grip. These movements can affect the accuracy and the range of the arrow shot from the bow. Generally, movements about the gripping location are divided into three different movements, namely, pitch, roll and yaw. Pitch occurs when the bow moves up or down from the perspective of an archer drawing or holding the bow. Roll occurs when the bow rotates clockwise or counter-clockwise, while in the archer's hand, from the point of view of the archer drawing the bow. Yaw generally relates to hand torque, where the bow has a tendency to wobble from side-to-side, or left-to-right, about the bow grip from the perspective of an archer drawing or holding the bow.

A variety of archery bow stabilizers are available which attempt to counter pitch, roll and yaw movement. Generally, these stabilizers are weighted and project forwardly from the riser of the bow. Many of these stabilizers are in the form of a cylindrical weighted rod that projects forwardly several inches from the riser.

Some stabilizer accessories offer variability in weight distribution. For example, there are some stabilizer mounts that project forward from a riser and include an elbow included right in the mount. A weighted stabilizer is threaded into the stabilizer mount. While the elbow of the mount enables the weighted stabilizer to be angled up or down, the majority of weight of the stabilizer remains forward of the riser. For those archers who desire weight elsewhere, the elbow is of little use.

There also are some stabilizer mounts that include multiple elbows located forward of the riser in the mount itself. Again, this forward mounting can provide some custom weight distribution, but it is limited when it comes to moving mass rearward of the riser.

While there are a variety of stabilizers on the market that provide specialized balancing and counter balancing of bows, there remains room for improvement for an all-purpose archery bow stabilizer that reduces or eliminates external asymmetric forces which can induce torque or instability in an archery bow.

SUMMARY OF THE INVENTION

A stabilizer for an archery bow is provided, the stabilizer including a continuous stabilizer bar having a first segment, a second segment and an articulating, lockable joint joining the first segment and the second segment. The joint enables the first segment and second segment to be selectively positionable at any one of multiple preselected bar angles relative to one another, so that a user can fine tune the orientation, mass distribution, balance and shooting characteristics of a bow to which the stabilizer is joined.

In one embodiment, the stabilizer includes a mount joined with the bar. The mount can be generally non-articulating and can define an opening, and the bar can be positioned and extend through the opening. The bar can be selectively rotatable about its axis within the opening. With such rotation, the first and/or second segment can be radially reoriented relative to the bar longitudinal axis at any one of a plurality of preselected radial angles.

In another embodiment, the first and second segments are of first and second lengths, being different from one another. Optionally, the first segment is longer than the second segment. The segments can include nearly identically configured exterior surfaces and associated diameters and/or circumferences so that either the first segment of the second segment can be selectively joined with the mount without modification. The other unjoined segment can be free to articulate about the articulating joint, moving relative to the segment joined with the mount.

In even another embodiment, the first and second segments can be moved along the bar axis to selectively position the articulating joint a preselected distance from the mount. The articulating joint also can be placed forward or rearward of the mount, depending on the user's preference.

In yet another embodiment, the articulating joint can include a fastener or pin joining the first and second segment. The first and second segment can be rotatable about a pivot axis coincident and/or coaxial with the fastener or pin. The fastener or pin can be used to set the first segment at a preselected bar angle relative to the second segment.

In a further embodiment, whichever of the first or second segment that is joined with the mount can be rotated to move the other segment relative to a horizontal plane. The other segment can be selectively deployed to a preselected bar angle, relative to the bar longitudinal axis, and disposed at some radial angle relative to the horizontal plane.

The archery bow stabilizer herein provides a simple and efficient stabilizing structure to reduce and/or inhibit roll, pitch and/or yaw of an archery bow while being held, drawn or shot by an archer. The archery stabilizer is highly adjustable to provide a variety of weight distributions and stabilizing effects for the archery bow to which it is mounted.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
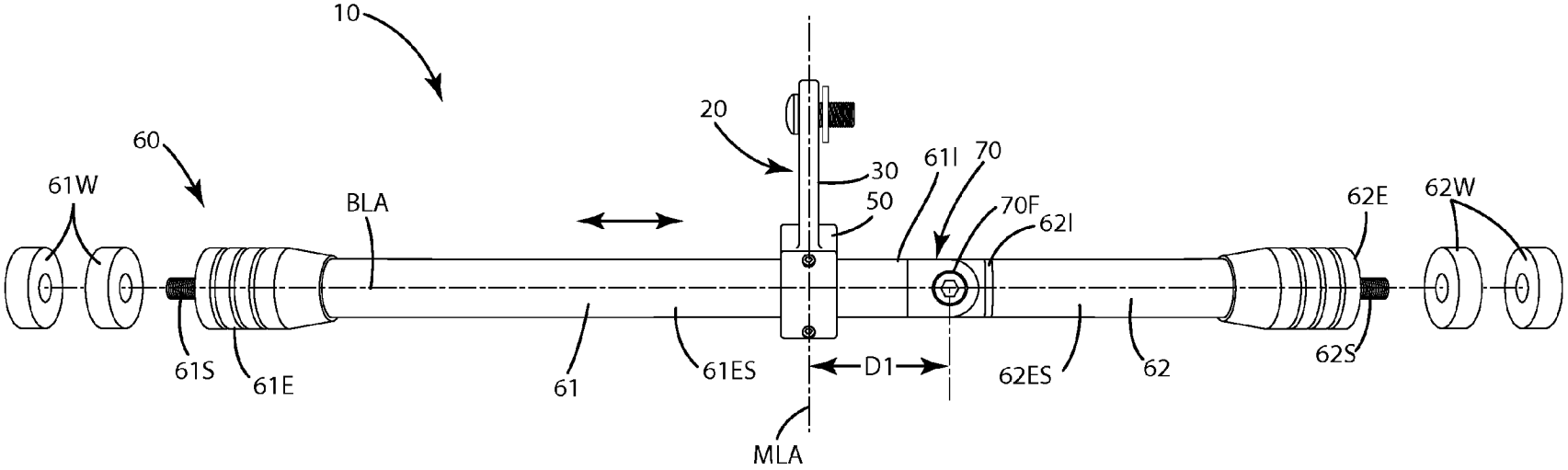
FIG. 1 is a perspective view of the stabilizer of the current embodiment unattached to an archery bow; and in a first straight configuration.

An archery bow stabilizer according to a current embodiment is illustrated in FIGS. 1-8 and generally designated 10. The stabilizer can include a mounting bracket 20, which mounts directly to the riser of an archery bow, a mounting arm 30 and a clamp 50 at an end of the mounting arm 30. The stabilizer can include a continuous stabilizer bar 60 which itself is broken or separated into distinct and independently constructed first segment 61 and second segment 62. The first segment 61 and second segment 62 are joined with one another via an articulating joint 70. The articulating joint can enable the first and second segments 61 and 62 to be moved within a first plane P (FIG. 5) to establish a bar angle $\alpha$ relative to a longitudinal axis BLA of the bar. In this manner, the ends 62E, and any associated weights 62W associated with the ends, can be reoriented in one segment relative to the other segment. In addition, the stabilizer bar can be slideably joined with the mount 20 so that it can be moved or slid in directions S1 and S2 to alter the distance D1 from which the articulating joint 70 is disposed relative to the mount 30 and/or the clamp 50. Optionally, each segment 61 and 62 can include similar outer dimensions and contours, each can thus be movable and/or slidable when mounted in the clamp 50 to the mount 20. In this manner, the distance D1 between the articulating joint 70 and the mount is infinitely variable. An archer can effectively attach the clamp 50 to either segment, and slidably move the articulating joint away from or toward the clamp 50 any desired distance D1.

Figure 5:
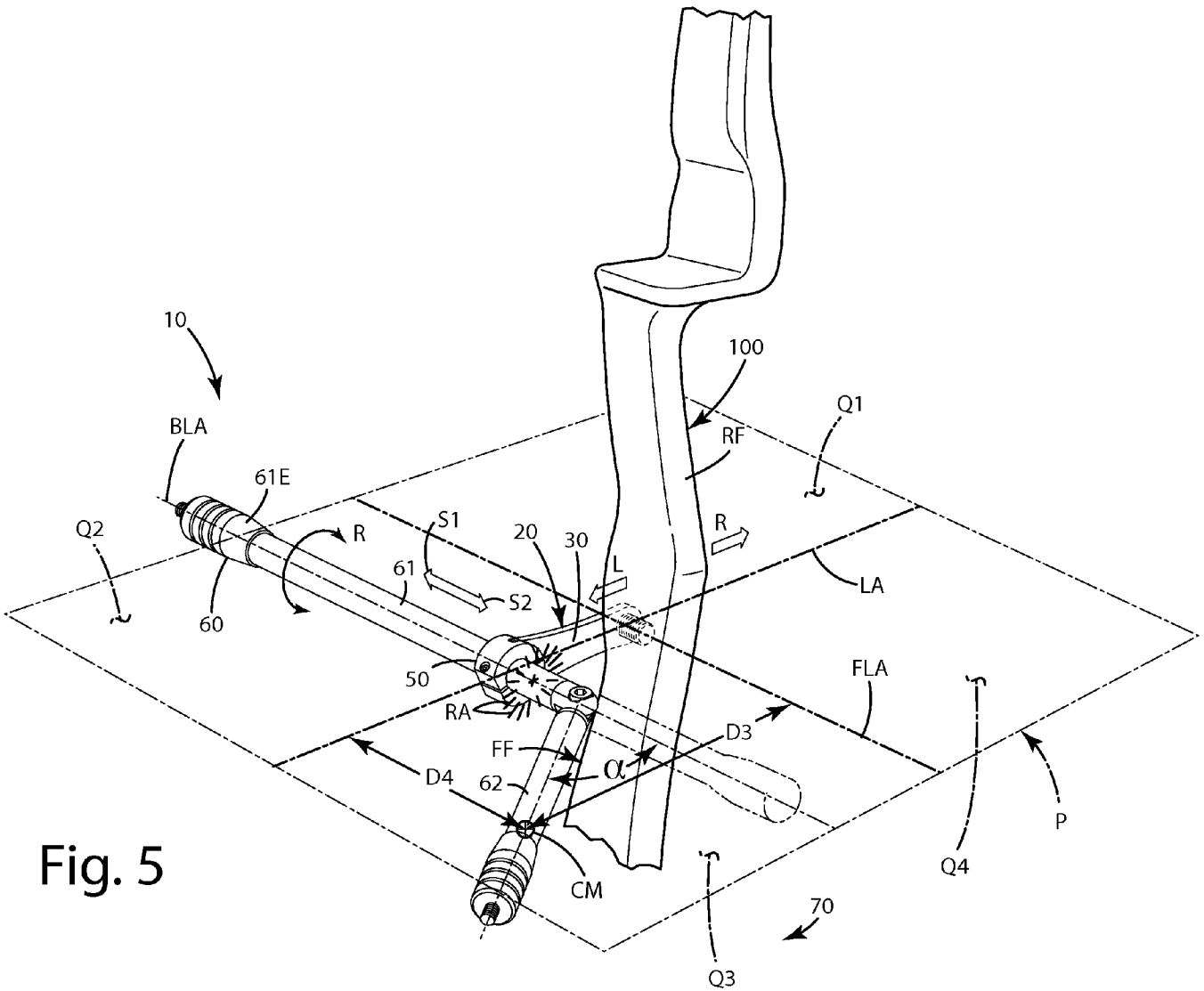
FIG. 5 is a perspective view of the stabilizer mounted to an archery bow with a second segment angled at a bar angle relative a relative to a first segment in a first plane.

Another adjustment is provided via the segments 61 and 62, whichever is clamped by the clamp 50, being rotatable in a direction R (FIG. 5). By rotating a segment relative to the clamp 50 and/or the mount 20, the other segment, for example, the second segment 62 can be selectively disposed in any one of a variety of radial angles RA about the bar longitudinal axis BLA. The first and second segments, accompanying weights can be selectively positioned in a variety of spatial orientations to provide balance and specified weight distribution to an archery bow to which the stabilizer is mounted.

The stabilizer 10 described herein is well suited for single cam compound archery bows, dual cam bows, cam and a half bows, re-curves, long bows, cross bows and other archery systems including a bow string. The stabilizer also can be adapted to fit other projectile shooting devices with the appropriate modifications.

Figure 4:
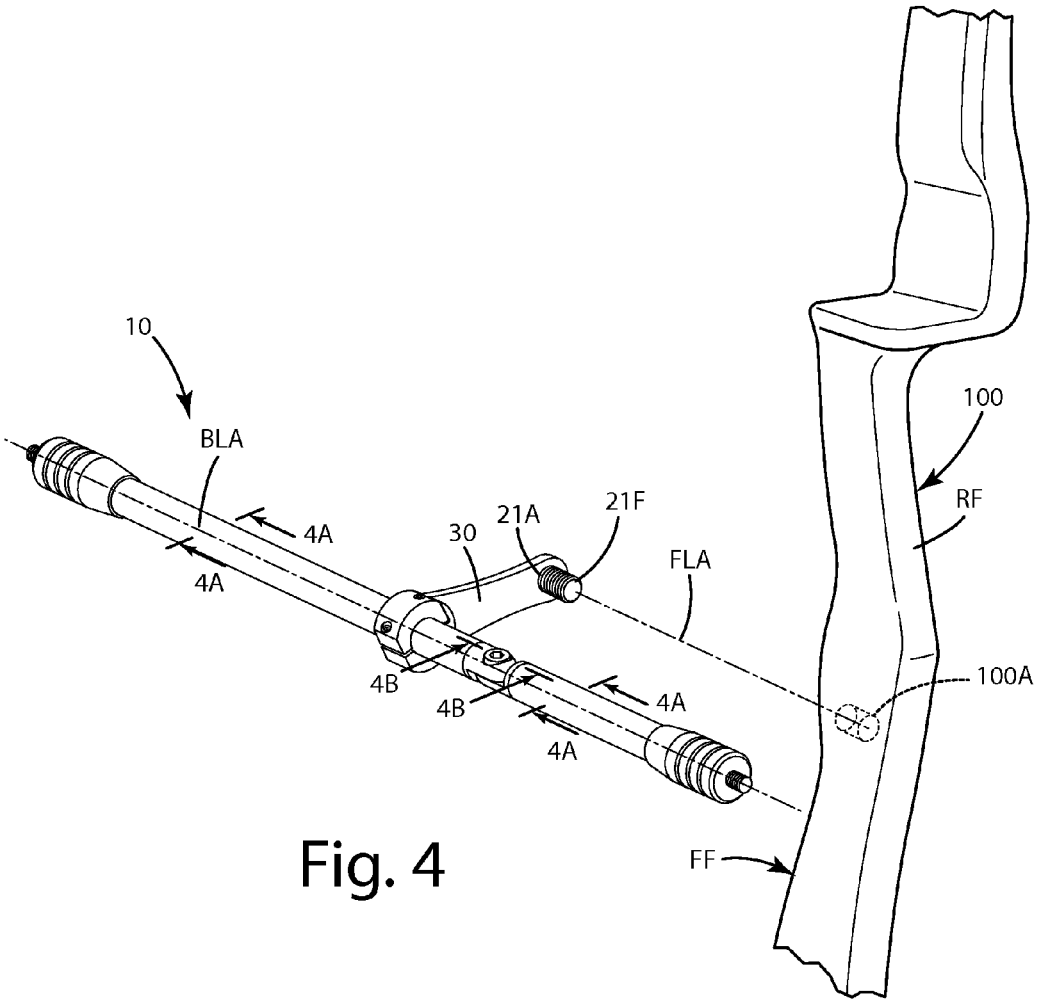
FIG. 4 is a perspective view of the stabilizer being mounted to the riser of an archery bow.
Figure 7:
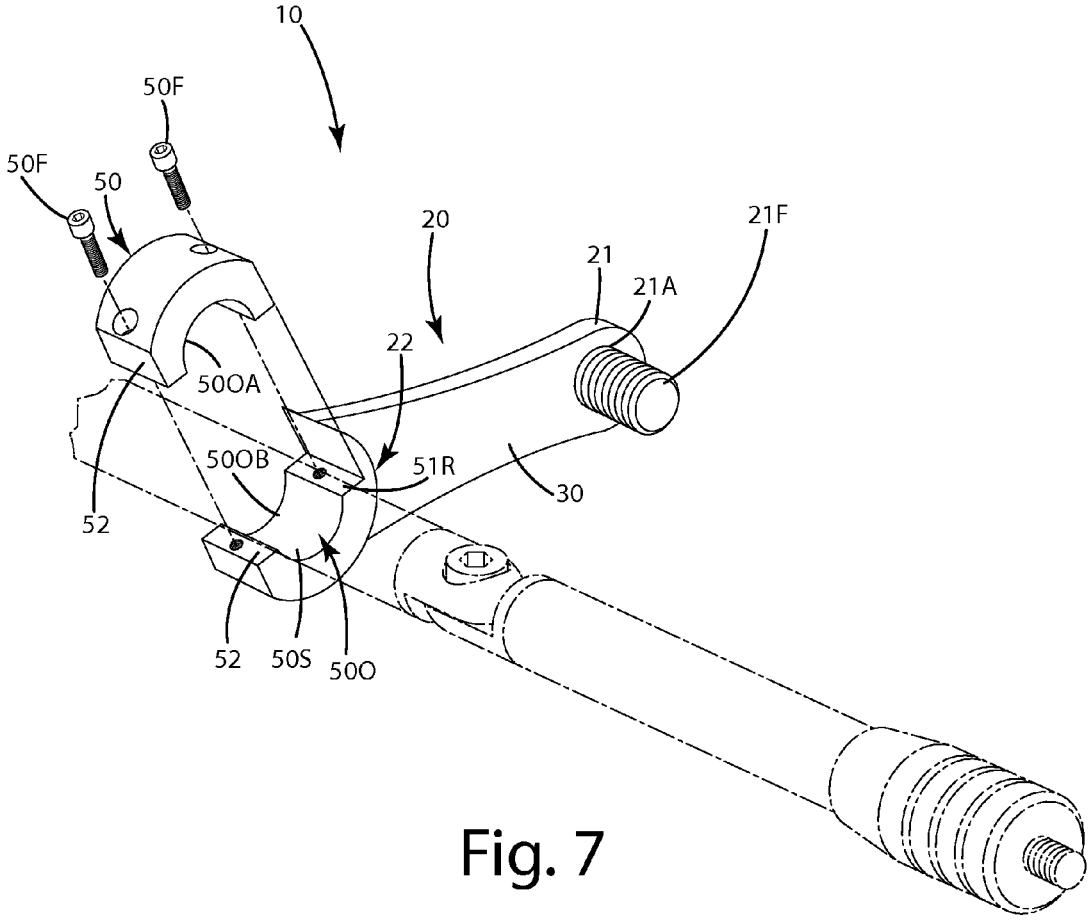
FIG. 7 is an exploded view of the mount and a segment disposed within the mount.

The construction of the stabilizer and its components will now be described in more detail. Referring to FIGS. 1, 4 and 7. The stabilizer includes a mount 20. The mount 20 can include an attachment portion at a first end 21. That attachment portion can generally include an aperture 21A through which a fastener 21F is positioned. The fastener can include a longitudinal axis FLA as shown in FIG. 4. This longitudinal axis FLA can align with a bore, threaded hole or aperture 100A in the archery riser 100. Generally, the fastener 21F can be screwed, threaded or otherwise installed in the aperture 100A to join the arm and/or the stabilizer to the front face of the archery bow 100. Of course, in some situations, the aperture 100A can be defined on the rear face RF of the riser 100 with the fastener 21F installed therein to join the stabilizer to the riser.

Optionally, the mount 20 can be mounted to the riser utilizing another mechanism. For example, a stud can project from the riser aperture 100A and a nut can be threaded over the end of the stud to hold the mount adjacent the riser. As another example, the bracket can include a quick disconnect attachment element, which can mount the bracket to the riser.

The mount 20 can include an arm 30 extending away from the fastener aperture 21A and the first end 21. This arm 30 extends generally toward the second end 22 of the mount 20. At the second end, a clamp 50 can be disposed and joined with the end 22. The clamp 50 can include a first portion 51 and a second portion 52. Optionally, the first portion 51 optionally can be integrally joined with or formed with the mounting arm 30. The clamp 50 and particularly the second part 52 can be separately formed from the first part 51, and removable from the mount. The second part 52 can be separable but fixedly joinable relative to the first part 51 and the clamp 50. The second part 52 can nest within a recess 51R of the first end 51. The precise portions of the recesses formed by the respective first and second parts can vary as desired. Further, additional parts can be incorporated into the clamp 50 to define the opening. In some cases, only one of the parts might define the recess, where the other part simply closes the opening 50O. Optionally, the clamp 50 can be in the form of a collet fitting that engages and holds the respective first or second segment disposed through the opening. Other configurations of clamping, holding or securing devices can be substituted for the illustrated clamp 50.

The clamp 50, and generally the mount 20, can define an opening 50O. This opening 50O can be cooperatively formed by the recesses 50OA and 50OB in the respective first and second parts of the clamp 50. The opening 50O can include an interior surface 50S that corresponds to and generally closely conforms to the exterior surfaces 61ES and 62ES of the first and second segments 61 and 62. As illustrated, the opening and the surface 50S are generally of a rounded or circular or cylindrical shape. Of course, it can be modified to be of a polygonal, square, rectangular, star or other shapes that optionally enables the segments 61 and 62 to be rotated to a variety of rotational radial angles about the bar longitudinal axis BLA.

Optionally, the mount 20 can be constructed so that the first clamp part 51 and second clamp part 52 can be joined together with fasteners 50F. These fasteners can project through openings defined by the second part 52 and into threaded openings defined by the first part 51. By tightening the fasteners 50F into the opening, the first and second parts can be drawn to one another to cooperatively clamp and/or sandwich the respective segment disposed within the opening 50O. As shown in FIG. 5, the mount 20 generally extends laterally outward away from the archery bow riser 100 to the left L of the riser. If desired, the mount can extend out the right R of the bow riser so that the mount and bar 60 are located in the opposite right side of the bow riser.

Turning now to the stabilizer bar 60 as described above, the stabilizer bar includes a first segment 61 and a second segment 62. The segments are joined via an articulating joint 70. Additional articulating joints and segments can be joined with the respective segments and/or additional segments as desired. These additional segments can provide further variability and weight distribution and/or balance to the bar 60. The segments and the bar in general can include ends 61E and 62E (FIG. 1). These ends can include one or more weights 61W and 62W joined with them. As illustrated, the ends 61E and 62E can include studs 61S and 62S that project from those ends generally along the bar longitudinal axis BLA. Weights 61W and 62W can include threaded openings. The weights can be threaded onto the respective studs to add the desired number of weights. The weights can be selectively applied in varying numbers, or even absent from the stabilizer bar to provide the desired weight distribution balance of the bow.

Figure 4A:
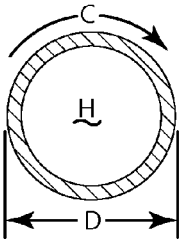
FIG. 4A is a sectional of the first and second segments taken along lines 4A-4A of FIG. 4.

The segments 61 and 62 can be constructed to form a tube-like structure. As shown in FIG. 4A, the segments can include a hollow core H. This hollow core H can be bounded by an outer tubular structure as illustrated. The hollow core can have a unitary, single diameter along the entire length of the segment. If desired of course, the stabilizer and the respective segments can be constructed from a solid bar or can have varying dimensions and shapes of the hollowed core H to provide the desired properties.

The segments 61 and 62 can include an exterior surface 61ES and 62ES. These exterior surfaces can be smooth and aesthetically pleasing. They also can be constructed to be of a preselected dimension or diameter D as shown in FIG. 4A and/or can include a preselected circumference C. The diameter D can range from about ¼ inch to about 2 inches, further optionally about ½ inch to 1 inch, and even further optionally about ¾ inch in diameter. Generally, the circumferences and diameters of the first and second segments and any other segments included with the stabilizer bar, can be identical. In this manner, either the first segment or the second segment can be placed within the opening 50O of the mount 20, fitting perfectly into that opening. When of different lengths, the segments can be set up so that either the longer segment or the shorter segment extends forwardly relative to the mount 20 depending on the user's preference. With the exterior surfaces being identical, either the first segment 61 or the second segment 62 can be engaged by the mount 20, and where included, the clamp 50 and the respective parts thereof to effectively lock and hold the segment in a fixed predetermined location suitable to the user.

The first segment 61 can be optionally about 6" to about 48", further optionally about 6" to about 36", further optionally about 6" to about 24", even further optionally about 6" to about 12". The second segment 62 can be about 4" to about 24", further optionally about 2" to about 12", even further optionally about 2" to about 6", depending on the particular application. Again, generally, one segment is longer than the other to provide greater variation in the weight distribution. In cases where both the first segment 61 and second segment 62 are equal, the variability might be compromised in weight distribution along one or both of the segments.

Figure 4B:
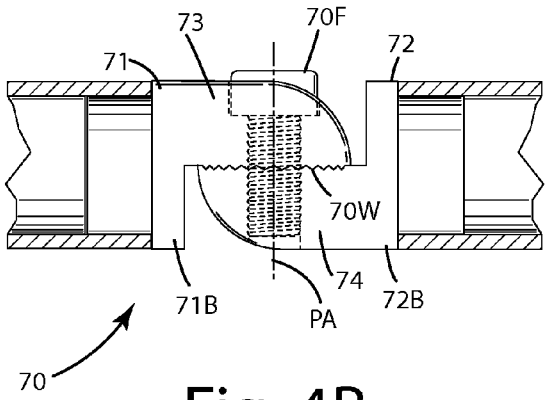
FIG. 4B is a partial sectional view of an articulating joint taken from perspective 4B of FIG. 4.

As shown in FIGS. 1 and 4B, the stabilizer 10 can include the articulating joint 70. This joint can be constructed from materials different from the first and second segments 61 and 62. Generally, the joint can be disposed at an intermediary end 611 of the first segment 61 and another intermediary end 621 of the second segment 62. If desired, the articulating joint 70 can include first 71 and second 72 ends that are selectively insertable inside the hollow core H of the segments 61 and 62. Alternatively, the ends 71 and 72 of the articulating joint can be disposed over and around the exterior surfaces 61ES and 62ES of the respective first and second segments. The ends 71 and 72 can be fastened, glued, cemented or integrally formed with the respective first and second segments 61 and 62.

Optionally, the articulating joint 70 can include first and second arms 73 and 74 that project from respective bases 71B and 72B associated with the ends 71 and 72. The arms 74 and 73 can overlap one another a preselected distance. In this area of overlap, a fastener or pin 70F can be joined with the respective arms 73 and 74. The fastener 70F can join the respective arms and accordingly join the first segment with the second segment.

The joint 70 can also include a metal compression washer 70W. Optionally, the washer can be constructed from an elastomeric or rubber structure that may deform or otherwise be able to hold the first arm and second arm in a fixed rotational position relative to one another about the pivot axis PA when compressed or deformed upon tightening of the fastener. Further optionally, the washer can be absent, and the surfaces of the arms facing one another can include ridges, knurling or other surface contours to assist in locking the arms in a fixed position when the fastener is tightened. The pin or fastener 70F can be adapted to loosen so that the arms can rotate about the pivot axis PA, and so that the corresponding first and second segments can be reoriented into multiple preselected bar angles $\alpha$ relative to one another.

Figure 2:
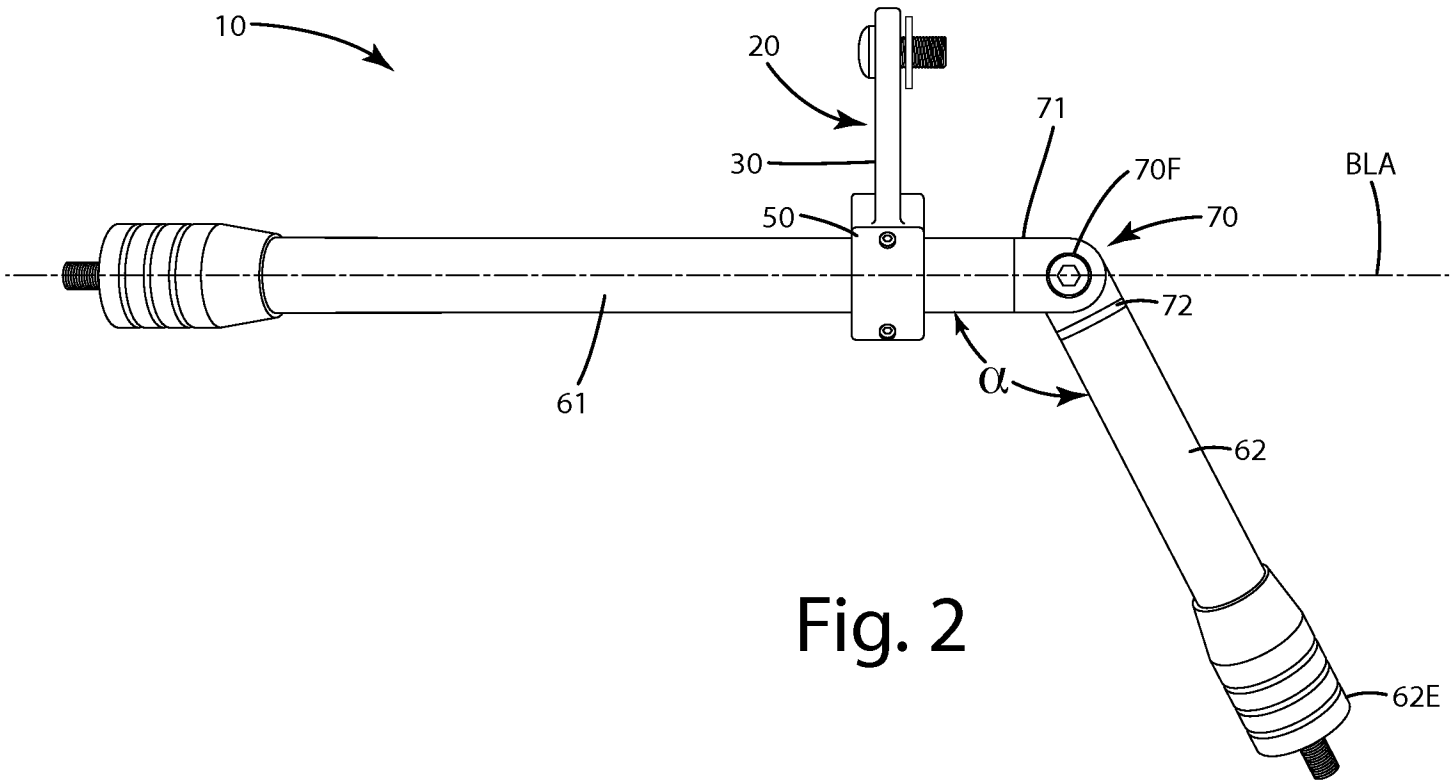
FIG. 2 is a second perspective view of the stabilizer in a second configuration with one segment angled relative to the other segment.
Figure 3:
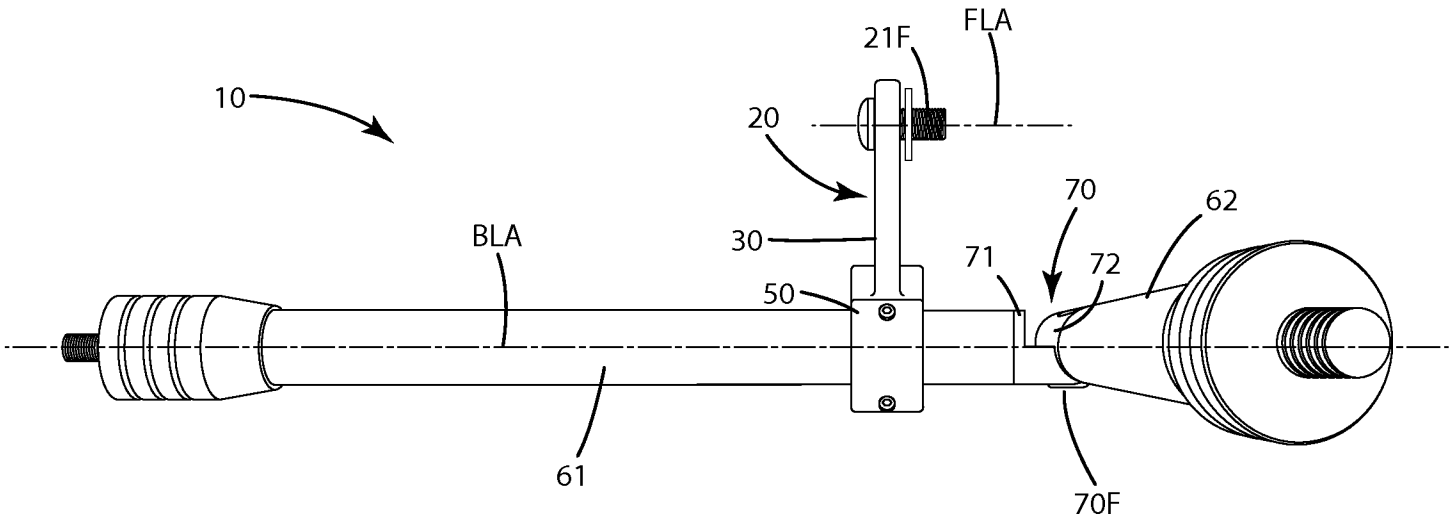
FIG. 3 is a perspective view of the stabilizer with one segment angled relative to the other segment, and the other segment rotated to some radial angle relative to a mounting element.

The surprising and unexpected capabilities of the articulating joint 70 are illustrated with reference to FIGS. 1, 2 and 5. For example, in FIG. 1, the articulating joint 70 enables the first and second segments to lay concentrically aligned and parallel along the bar longitudinal axis BLA, generally lining up the stabilizer in a straight line. If the user desires to keep both segments in a straight line, but reorient the entire bar relative to the mount 20, the user can loosen the clamp 50 and slide the segment therein so that the joint 50 is an acceptable distance D1 from the clamp 50. The user then tightens the clamp to secure the segments in position.

If the user desires to reorient the second segment 62 relative to the first segment 61 to attain yet a different weight distribution, the user can loosen the fastener 70F and rotates the second segment 62 to a preselected bar angle $\alpha$ (FIG. 5). This bar angle $\alpha$ can be in a desired angle, ranging from about 0° to 180° relative to the bar longitudinal axis BLA, optionally about 1° to about 90°, further optionally about 1° to about 45°, depending on the particular application. FIG. 5 illustrates a first plane, that generally cuts through the riser and/or mount and bar. As illustrated, the continuous bar 60 and its components 61 and 62 can be located within the first plane P. This plane can optionally be a horizontal plane in some instances. As mentioned above, with the articulating joint 70, a user can rotate the second segment 62 relative to the first segment 61 to establish a predetermined angle $\alpha$ relative to the bar longitudinal axis BLA. As illustrated, this rotation can occur generally in the third quadrant Q3 of the plane as depicted in FIG. 5. Of course, depending on the particular orientation of the mount and the segments, this rotation can alternatively occur in the first quadrant Q1, second quadrant Q2, third quadrant Q3 and/or fourth quadrant Q4. By rotating the second segment 62, the user can reorient the center of mass CM from the second segment 62 anywhere within the third quadrant Q3. Generally, the user can move the center of mass CM toward or away from the axis FLA, which optionally bisect the bow into left and right portions, and/or toward and away from the lateral axis LA, which bisects the bow into front and rear portions through the bow riser 100 as illustrated.

With reference to FIG. 5, the center of mass CM of the second segment 62 can be moved a preselected distance D3 away from the axis FLA. This distance can vary, depending on the preselected bar angle $\alpha$ and the location of the first segment relative to the second segment and to the mount 20.

As mentioned above, the segments and bar can be rotatable in direction R (FIG. 5) about the bar longitudinal axis BLA. The segments also can be slideable in directions S1 and S2 (FIG. 1) through the opening defined by the clamp 50 as shown in FIG. 5. By moving the segment 61 within the clamp, the distance between the end 61E and the mount 20 can be varied. Likewise, the distance between the articulating joint 70 and the mount 20 can be varied. In this manner, the center of mass CM of the second segment 62 can be moved varying distances D4 (FIG. 3) relative to the left to right axis LA of the riser 100.

Figure 6:
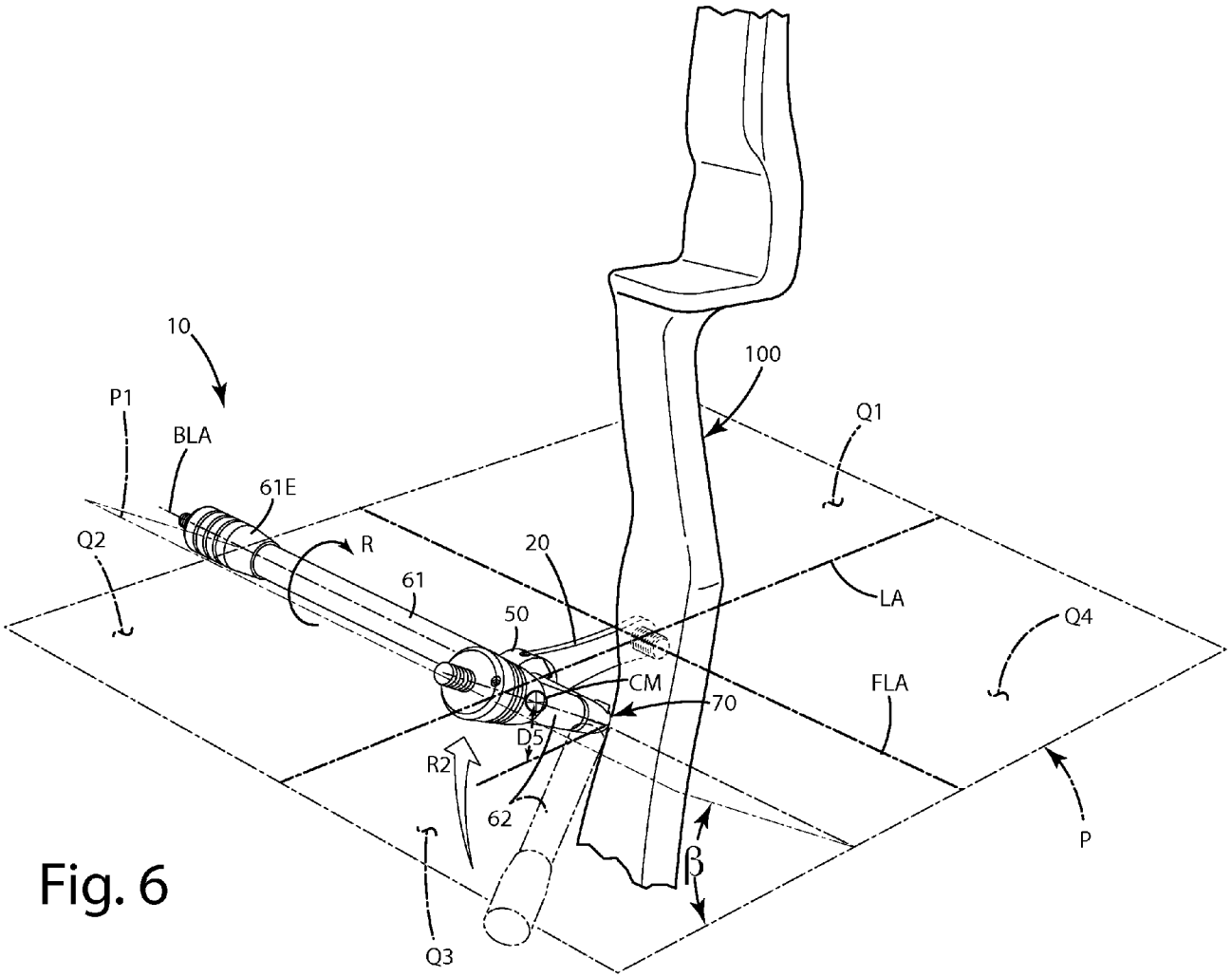
FIG. 6 is a perspective view of the stabilizer with the second segment angled relative to the first segment, and disposed in a second plane that is rotated relative to the first plane.

As shown in FIGS. 5 and 6, the segments also can be movable so that the one or both of the segments can be rotated out of the first plane P to redistribute weight and balance of the stabilizer. For example, as illustrated in FIG. 6, the center of mass CM can be disposed a preselected distance D5 from the plane P, measured along a line orthogonal to the horizontal plane P, to accommodate a user's preference. As another example, the second segment 62 can be rotated in a direction R2. This occurs when the clamp 50 is loosened and the first segment 61 is rotated. The rotation R of the first segment 61 about the bar longitudinal axis BLA results in a rotation R2 of the second segment 62 in the same general rotational direction. In turn, the second segment leaves the first plane P and is disposed in the plane P1. This plane P1 can intersect the plane P and be at some planar angle $\beta$ relative to the same. The precise angle $\beta$ can correspond to the radial angle RA (FIG. 5) about which the segment 62 is rotated relative to the bar longitudinal axis BLA. After the rotation R has achieved its desired orientation of the center of mass CM or otherwise balance of the first and second segments relative to the riser 100, the user can engage the clamp 50 so that the first segment 61 is fixedly held in position relative to the clamp and the mount 20. As a result, the second segment also is fixedly held in the plane P1 and at some radial angle RA.

Although shown as being rotatable about the axis BLA in a direction R2 above the horizontal plane P, the segments can also be rotatable in an opposite direction downward from the horizontal plane P to some other orientation, with the center of mass CM being disposed some preselected distance below the plane P. Again, the particular distance D5 and its direction (above, below or in the plane P) can be selected depending on the weight distribution characteristics preferred by the user.

Figure 8:
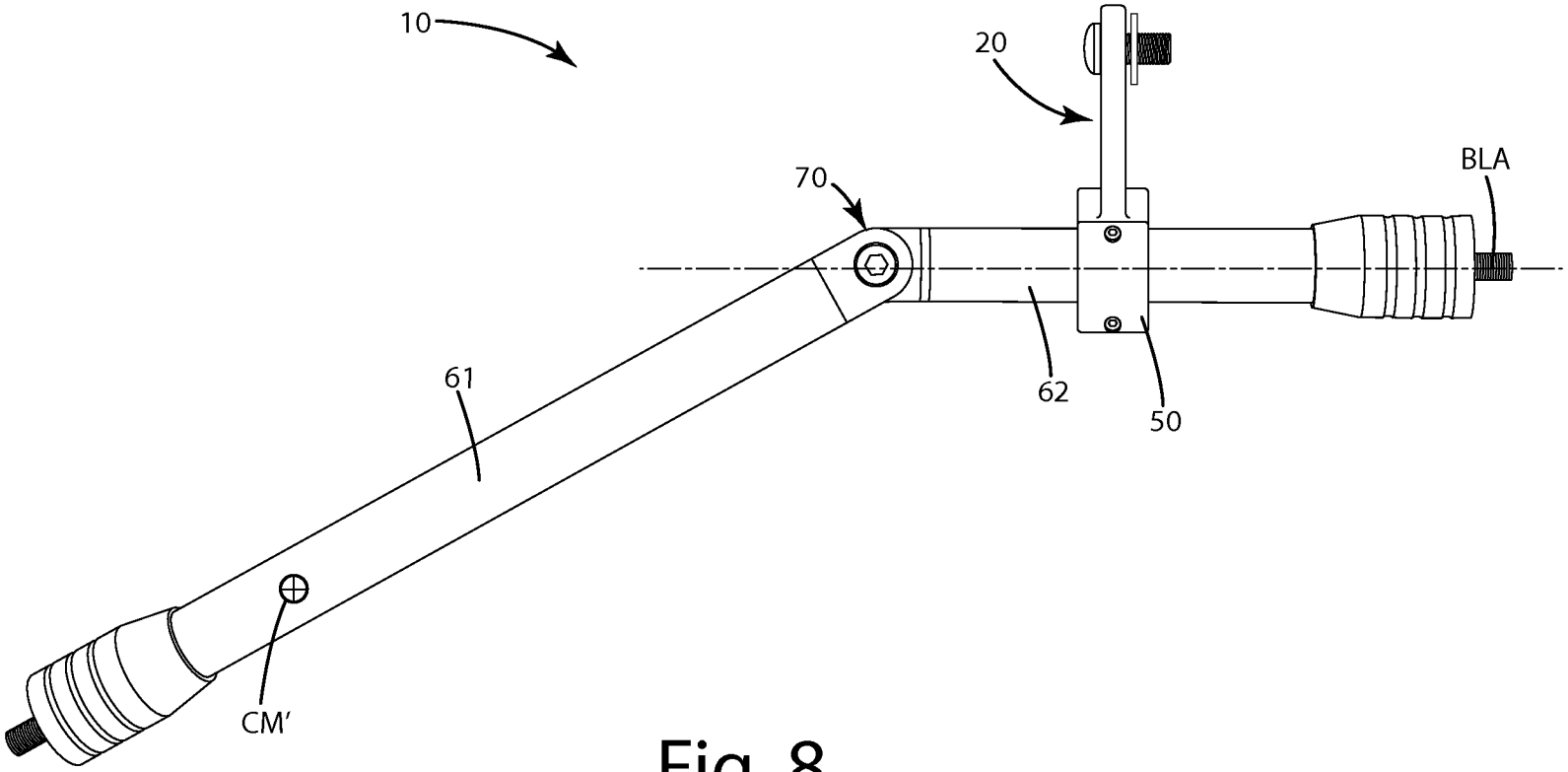
FIG. 8 is a perspective view of the stabilizer with the second segment joined with the mount to redistribute weight of the stabilizer.

As shown in FIG. 8, the stabilizer 10 is adjustable so that the second segment 62 can be engaged by the mount and particularly the clamp 50. In this construction, the second segment can be disposed within an opening of the clamp 50 and secured in a fixed rotational orientation relative thereto. The second segment 62 also can be slid forward and rearward depending on a user's preference. In this construction, the first segment 61, which again can be generally longer than the second segment 62, can be articulatable to various radial angles and to various preselected bar angles relative to the bar longitudinal axis BLA. In this manner, the center of mass CM' of the first segment 61 can be adjusted in various orientations similar to that of the center of mass CM of the second segment 62 as described above.

The mount, clamp, fasteners, stabilizer bar, segments as well as the other components of the stabilizer can be constructed from any material, such as aluminum, aluminum alloys, magnesium, metals, plastics, synthetic materials, carbon, composites and the like and can be CNC machined, molded, cast or otherwise formed using conventional construction processes.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery stabilizer comprising:

a mount including an arm and an end, a clamp defining an opening at the end, the mount having a mount longitudinal axis, a continuous stabilizer bar having first and second ends, the stabilizer bar subdivided into a first segment and a second segment, the first segment including the first end, the second segment including the second end, the first segment being longer than the second segment, the first segment and the second segment each having respective regions that engage the mount, the regions being identical in cross section, the stabilizer bar having a bar longitudinal axis that is perpendicular to the mount longitudinal axis, with the stabilizer bar extending through the opening, a first weight attached to the first end, a second weight attached to the second end of the continuous stabilizer bar; and an articulating joint disposed between the first segment and the second segment, between the first and second ends of the stabilizer bar, the joint enabling the first and second segment to rotate relative to one another in a first plane so that a preselected bar angle can be established between the first segment and the second segment, wherein the first and second segments of the stabilizer bar extend alongside and lateral to a bow riser, wherein the first and second segments can align along the bar longitudinal axis, wherein the first segment is selectively disposable and slideable within the opening when the clamp is loosened, wherein the first segment is selectively rotatable in the opening to reorient the second segment, removing the second segment from the first plane and moving the second segment to a second plane different from the first plane, with the first and second segments remaining at the preselected bar angle relative to one another.

2. The archery stabilizer of claim 1 comprising a first weight removably joined with the first segment, and a second weight selectively joined with the second segment.

3. The archery stabilizer of claim 1, wherein the articulating joint includes a first arm joined with the first segment, wherein the articulating joint includes a second arm joined with the second segment, wherein the first arm and second arm overlap one another and are selectively held in a fixed relation with a fastener.

4. The archery stabilizer of claim 3 wherein the articulating joint is selectively disposable rearward of the mount and rearward of the bow riser.

5. The archery stabilizer mount of claim 4, wherein the clamp includes first and second portions that collectively form the opening;

wherein the opening is identical in shape to both an exterior of the first segment and an exterior of the second segment.

6. The archery stabilizer of claim 5 wherein the first segment and second segment are configured to selectively, coaxially align along the bar longitudinal axis, yet are selectively adjustable to establish the preselected bar angle between the first segment and the second segment.

7. The archery stabilizer of claim 1 comprising a threaded stud extending from the first segment, and a weight threaded onto the threaded stud.

8. An archery stabilizer comprising:

a mount adapted to extend laterally from a bow riser;

a stabilizer bar joined with and transverse to the mount, the stabilizer bar including a first segment and a second segment of different lengths, the first segment fixedly restrained by the mount and extending forward of the mount, the second segment extending rearward of the mount, the stabilizer bar configured to extend forward and rearward of the bow riser when installed relative to the riser, the first segment and second segment selectively alignable along a bar longitudinal axis;

an articulating joint disposed between and joined with each of the first segment and the second segment, the articulating joint enabling the second segment to be selectively rotated, out of alignment with, and to a preselected bar angle relative to, the first segment within a first plane, wherein the first segment is selectively rotatable relative to the mount so that the second segment can be vertically reoriented on a lateral side of the bow riser, whereby a center of mass of the second segment can be selectively positioned by a user in multiple positions above, below or even with the mount.

9. The archery stabilizer of claim 8, wherein the mount extends laterally at least one inch from the bow riser, wherein a fastener having a fastener longitudinal axis is configured to join the mount with a bow riser, wherein the bar longitudinal axis is parallel to the fastener longitudinal axis when the stabilizer is installed on the bow riser.

10. The archery stabilizer of claim 9 wherein the mount includes a clamp including a first part that is fastened with fasteners to a second part, with the first segment sandwiched therebetween.

11. The archery stabilizer of claim 9 wherein the first segment includes a first exterior circumference and the second segment includes a second exterior circumference, wherein the first exterior circumference and second exterior circumference are equal.

12. The archery stabilizer of claim 11 wherein the mount includes a clamp having a clamping surface that corresponds to and is substantially identical to but larger than the first and second exterior circumference.

13. The archery stabilizer of claim 12 wherein the clamp defines an opening, wherein the clamping surface is located within the opening.

14. The archery stabilizer of claim 9 wherein the stabilizer bar is continuous from a first end to a second end, with the first and second segments located between the first and second ends.

15. The archery stabilizer of claim 14 wherein the stabilizer bar extends through an opening defined by the mount.

16. An archery stabilizer comprising:

a mount adapted to join with a bow riser, a continuous stabilizer bar joined with the mount, the bar including a first segment, a second segment having a center of mass, and a bar longitudinal axis, an articulating, lockable joint joining the first segment and the second segment, the articulating joint enabling the second segment to be selectively rotated, out of alignment with, and to a preselected bar angle relative to, the first segment within a first plane, wherein the continuous stabilizer bar is selectively slideable forward and rearward along the bar longitudinal axis and relative to the mount so that the articulating joint can be selectively distanced relative to the mount, wherein the first segment and second segment are configured to selectively, coaxially align along the bar longitudinal axis, yet are selectively adjustable to establish the preselected bar angle between the first segment and the second segment, wherein the first segment and second segment are selectively positionable and lockable at any one of a plurality of preselected bar angles relative to one another, wherein the second segment is selectively moveable to vertically reorient the center of mass, whereby a user can selectively angle the first and second segments relative to one another and relative to the mount, and place the center of mass at a preselected vertical location, to balance the bow to their preferences.

17. The archery stabilizer of claim 16, wherein the first segment is longer than the second segment defined by the mount.

18. The archery stabilizer of claim 16, wherein the first segment is selectively rotatable relative to the mount, wherein rotation of the first segment vertically reorients the center of mass of the second segment by rotating the second segment clockwise or counter-clockwise about the bar longitudinal axis, wherein the articulating joint includes a first arm joined with the first segment, wherein the articulating joint includes a second arm joined with the second segment, wherein the first arm and second arm overlap one another and are selectively held in a fixed relation with a fastener.

19. The archery stabilizer of claim 16, wherein the first segment includes a first exterior circumference and the second segment includes a second exterior circumference, wherein the first exterior circumference and second exterior circumference are equal in length, wherein the first segment is directly joined with the second segment at the articulating joint.

20. The archery stabilizer of claim 19 wherein the mount defines an opening having at least one surface complimentary to the first exterior circumference and second exterior circumference.

* * * * *